US007402553B1

(12) United States Patent
Perry

(10) Patent No.: US 7,402,553 B1
(45) **Date of Patent: *Jul. 22, 2008**

(54) METHOD FOR PREPARING A BUFFERED ACID COMPOSITION

(76) Inventor: Stephen C. Perry, 90 Kerry Place, Suite 2, Norwood, MA (US) 02062

( * ) Notice: Subject to any disclaimer, the term of this patent is extended or adjusted under 35 U.S.C. 154(b) by 0 days.

This patent is subject to a terminal disclaimer.

(21) Appl. No.: 11/622,831

(22) Filed: Jan. 12, 2007

(51) Int. Cl.
*C11D 7/08* (2006.01)
*C11D 7/32* (2006.01)
*C11D 11/04* (2006.01)

(52) U.S. Cl. ..... 510/263; 510/202; 510/245; 510/253; 510/258; 510/269; 510/435; 510/499

(58) Field of Classification Search ..... 510/202, 510/245, 253, 258, 263, 269, 435, 499
See application file for complete search history.

(56) References Cited

U.S. PATENT DOCUMENTS

| | | | | |
|---|---|---|---|---|
| 5,672,279 | A | 9/1997 | Sargent et al. | |
| 2003/0004080 | A1 | 1/2003 | Lunner et al. | |
| 2004/0099289 | A1 * | 5/2004 | Kawaguchi et al. | 134/27 |

* cited by examiner

*Primary Examiner*—Brian P Mruk
(74) *Attorney, Agent, or Firm*—Malin Haley DiMaggio Bowen & Lhota, P.A.

(57) ABSTRACT

A buffered acid composition created by the combination of liquid ammonia and an acid and a method for making the composition. The buffered acid composition is for use as a cleaning agent and for balancing the pH of a fluid.

7 Claims, No Drawings

METHOD FOR PREPARING A BUFFERED ACID COMPOSITION

BACKGROUND OF THE INVENTION

1. Field of the Invention

The invention relates to a buffered acid composition and a method for manufacturing said buffered acid composition.

2. Description of Related Art

Buffered acids have many different utilities, including use as cleaning compositions as well as pH balancers. One important use of buffered acids is for the pickling of stainless steel. Pickling is the cleaning and removal from stainless steel of any type of high temperature-related scale caused by heat treatment or weld burn. Stainless steel that is heated by welding, heat treating, or any other means may develop a multicolored oxide layer (referred to as "bluing") on the surface. This oxidation is indicative of a chromium-depleted layer on the surface of the steel below the oxide layer. When the chromium content in stainless steel is decreased, the corrosion resistance of the stainless steel also decreases. Acid cleaners, also known as pickling agents, are the most effective means of restoring maximum corrosion resistance to oxidized stainless steel. Pickling is an acid treatment used to remove high temperature scale and red rust from the steel or from corrosion of contaminant iron and steel particles. High temperature dark scale is undesirable for aesthetic reasons and because the scale reduces the corrosion resistance of the underlying steel layer.

Several patents describe pickling agents produced from the mixture of an acid or acids and urea. U.S. Patent Application Publication No. 2003/0004080 describes a pickling agent containing urea and the method of producing that agent. In most pickling agents, nitric acid is used, however, when the nitric acid contained in those pickling agents oxidizes metal, harmful free radicals of nitrogen oxide (referred to as NOx) and nitrates are released as a by-product of the pickling process. Fumes of the various nitrous oxides are toxic to humans working in close proximity to the pickling agent, and both the fumes and the nitrates are environmental hazards. Alternative pickling methods utilize hydrogen peroxide, sulfuric acid, and $Fe^{3+}$ as oxidizing agents, thereby circumventing the problems inherent in the usage of nitric acid. However, pickling compositions using these particular alternative agents are not as effective as compositions using nitric acid.

U.S. Pat. No. 5,672,279, issued to Sargent et al., on Sep. 30, 1997, describes a method for removing the accumulation of water-insoluble metal salts from surfaces using urea hydrochloride. The '279 invention does not use liquid ammonium combined with an acid to create that cleaning composition.

Nitrous acid ($HNO_2$) is also used as in buffered acid compositions, however, nitrous acid is unstable and is always prepared in situ. Nitrous acid is usually made by reacting a solution containing a nitrogen source (such sodium or potassium nitrate (III)) with hydrochloric acid. The nitrous acid is a weak acid and undergoes the following reaction:

$$H^+(aq)+NO_2^-(aq)\leftrightarrow HNO_2(aq)$$

Because nitrous acid is a weak acid, the position of equilibrium lies well to the right of the equation. Furthermore, the reactant solution will contain various ammonium ions and nitrite ions and also chloride ions from the hydrochloric acid. These ions remain in solution and are undesirable due to their toxicity.

A buffered acid solution is needed in the art which does not contain nitric acid or nitrous acid and which does not produce toxic flues or free radicals that are harmful to humans or to the environment, but that is effective for purposes of cleaning water-insoluble mineral and chemical accretions from hard surfaces as well as for balancing the pH of substances when needed.

SUMMARY OF THE INVENTION

Buffered acid compositions are effective cleaning agents and are also useful for balancing the pH of other fluids, including water in swimming pools and water treatment plants. The present buffered acid composition comprises a reacted combination of liquid ammonia and hydrochloric acid. Other acids or acid blends may also be used to create less effective buffered acid compositions. The composition is created by heating and mixing the acid within a reactor while slowly introducing liquid ammonia. Next, the composition is placed under vacuum at 20 inches of mercury in pressure while continuing to heat said composition. Then, the buffered acid composition is placed under vacuum at 30 inches of mercury in pressure while continuing to be heated. Finally, said composition undergoes cooling prior to packaging. The final buffered acid composition product is a liquid capable of cleaning and removing water-insoluble salts and other accumulated deposits that adhere to hard surfaces such as those of plumbing pipes and stainless steel.

The buffered acid composition works by means of a Bronsted-Lowry reaction in which ammonium cations formed by protonation of the ammonia replace the ammonia as a base. In a Bronsted-Lowry acid-base equilibrium reaction, the transfer of hydrogen ions ($H^+$) occurs in both directions so that the product of the reaction between the acid and a base is a conjugate acid and a conjugate base. The conjugate base is created when the acid reacting in an acid-base reaction loses hydrogen ions. Similarly, the conjugate acid is created when the base gains a proton. Two substances that differ by only one hydrogen ion are a conjugate acid-base pair. There is an inverse relationship between the strength of conjugate acid-base pairs. The stronger the acid, the weaker is its conjugate base. Likewise, the stronger the base, the weaker is its conjugate acid. This inverse relationship can be expressed by the following equation:

$$K_aK_b=K_w=1.0\times10^{-14}$$

This equation requires that the acid and base is a conjugate acid-base pair. Because the conjugate base loses a hydrogen ion, said conjugate base usually has a negative charge. With the exceptions of chloride, bromide, iodide, nitrate, chlorate, chlorite, and sulfate ions, most anions function as bases. Conjugate bases of strong acids are very weak bases and will not react with water. The hydrochloric acid of the present invention is a strong acid, and thus, forms a weak conjugate base when reacted with ammonia.

Most cations function as acids. With nitrogen bases, the hydrogen bonded to the nitrogen creates the conjugate acid of the nitrogen base. Metal ions can also act as bases. In aqueous solutions, metal ions normally bond to several water molecules. A hydrogen ion can be removed from one of the water molecules (leaving a hydroxide ion bonded to the water), thereby increasing the overall concentration of $H_3O^+$ in the solution. The cations associated with the strong bases of group I metal ions, including $Ca^{2+}$, $Sr^{2+}$, and $Ba^{2+}$, do not react with water.

An object of the invention is to provide a buffered acid composition for use in cleaning and removing water-insoluble chemical and mineral deposits from the surface of stainless steel and other hard surfaces.

Another object of the invention is to provide a buffered acid composition for use in balancing the pH of other substances.

Still another object of the invention is to provide a buffered acid composition that does not contain nitric acid or other chemicals prone to forming toxic and environmentally unsafe fumes and byproducts.

Yet another object of the invention is to provide a buffered acid composition for pickling stainless steel.

In accordance with these and other objects which will become apparent hereinafter, the instant invention will now be described with particular reference to the accompanying drawings.

DETAILED DESCRIPTION

The inventions described herein relate to a buffered acid composition and a method for making said composition. The composition comprises an acid reacted with liquid ammonia. In the most preferred embodiment, liquid ammonia ($NH_3$) is reacted with the acid. The buffered acid composition is preferably 23.0-33.0 percent by weight ammonia, and most preferably, 26.0 percent by weight ammonia. Combination of the liquid ammonia and acid produces a weak base by means of a Bronsted-Lowry reaction. The ammonia molecules undergo protonation and receive one hydrogen atom from the acid to form ammonium ($NH_4^+$) cations. The ammonium cations are the conjugate base of the ammonia. Where hydrochloric acid is used, the ammonium cations react with free chloride anions (produced by deprotonation of the acid) to form ammonium chloride, which exhibits low corrosivity. The ammonium chloride has unique cleansing properties and is amphoteric.

Hydrochloric acid is the most preferred acid that is reacted with the liquid ammonia to create the buffered acid composition. Thus, in the most preferred embodiment, the composition comprises hydrochloric acid reacted with liquid ammonia. A blend of hydrochloric acid and phosphoric acid is an alternate preferred acid for reacting with said ammonia. The acid may also be selected from one or more of the following acids or blends of said acids: hydrochloric acid, acetic acid, ascorbic acid, boric acid, citric acid, lactic acid, oxalic acid dehydrate, phosphoric acid, salicylic acid, and sulfonic acid. Once prepared and cooled, the buffered acid composition is a liquid.

When applied to a hard surface, such as metal or plastic, the buffered acid composition acts rapidly to clean and remove oxide discoloration, rust, and high temperature-related scale. The composition is particularly useful for cleaning and removing oxide discoloration, rust, and high temperature-related scale, including but not limited deposits and accumulations of calcium carbonate, barium sulfate, and other alkali salts from stainless steel and other metallic surfaces and hard surfaces. For example, the composition can be used to clean and remove the above-referenced chemical deposits and accumulations from PVC (polyvinyl chloride) pipes and other piping installed in water supply and water treatment systems. Because nitric acid is not a component of the buffered acid, the composition is also beneficial and useful for cleaning stainless steel and other hard surfaces in food processing areas, hospitals and other medical treatment areas, and in other locations where the use of other hazardous, fume-producing cleaning agents would pose a serious health risk to humans. Use of the composition as a pickling agent that is applied to stainless steel is also advantageous because stainless steel that is pickled using this composition need not undergo passivation to achieve corrosion resistance.

The method for preparing the buffered acid composition comprises a series of steps in which the liquid ammonia and acid are mixed and reacted within a heated and pressurized reactor and then a period of cooling prior to packaging the composition. First, an acid is mixed and heated within a reactor for 1.4 to 6.5 hours while slowly introducing liquid ammonia into said reactor. In this step, the composition is maintained at a temperature in the range of 140 to 335 degrees Celsius, and in a preferred range of 200 to 275 degrees Celsius. The preferred length of time for which this step of the method continues is approximately 2.0 to 5.0 hours. A sufficient amount of ammonia is added to the acid to form a buffered acid composition that is preferably 23.0-33.0 percent by weight ammonia, and most preferably, 26.0 percent by weight ammonia.

Second, the buffered acid composition is placed under vacuum at a pressure of 15 to 25 inches of mercury while maintaining a temperature in the range of water 140 to 335 degrees Celsius. The preferred temperature is a range of 200 to 275 degrees Celsius. The preferred pressure inside said reactor for this step is approximately 20 inches of mercury. This step is continued for approximately 1.0 to 2.0 hours, and preferably for 1.5 hours.

Next, the pressure of the reactor is increased so that the buffered acid composition is placed under vacuum at a pressure of 25 to 35 inches of mercury while maintaining a temperature in the range of 140 to 335 degrees Celsius. The preferred temperature is a range of 200 to 275 degrees Celsius. The preferred pressure inside said reactor for this step is approximately 30 inches of mercury. This step is continued for approximately 2.0 to 4.0 hours, and preferably for 3.0 hours. Finally, the buffered acid composition is cooled and removed from the reactor for packaging. The cooled buffered acid composition is a liquid.

The buffered acid composition can be used in a method for cleaning stainless steel and other hard surfaces by applying said buffered acid composition to the hard surface of an object and wiping or scrubbing particulate and liquid debris from said surface. Water-insoluble chemical and mineral deposits that may be cleaned and removed from hard surfaces by the composition using this method include oxide discoloration, rust, and high temperature-related scale, including but not limited deposits and accumulations of calcium carbonate, barium sulfate, and other alkali salts.

Said buffered acid composition may also be used in a method for balancing the pH of a substance, and particularly of fluids, by adding the buffered acid composition to the substance. For example, the composition and method can be used to balance the pH of water in swimming pools, water treatment systems and facilities, and for use with chelators used for personal care. The methods and composition described herein may also be used for cleaning and pH balancing in pulp and paper manufacturing plants and equipment.

The instant invention has been shown and described herein in what is considered to be the most practical and preferred embodiment. The applicant recognizes, however, that departures may be made therefrom within the scope of the invention and that obvious modifications will occur to a person skilled in the art.

What is claimed is:

1. A method for preparing a buffered acid composition, said method comprising the following steps:

(1) at a temperature in the range of 140 to 335 degrees Celsius, mixing and heating an acid while slowly introducing liquid ammonia to form a buffered acid composition;

(2) placing the buffered acid composition under vacuum at a pressure of 15 to 25 inches of mercury while maintaining a temperature in the range of water 140 to 335 degrees Celsius;

(3) placing the buffered acid composition under vacuum at a pressure of 25 to 35 inches of mercury while maintaining a temperature in the range of 140 to 335 degrees Celsius; and (4) cooling the buffered acid composition.

2. The method of claim 1, wherein step 1 of said method is continued for 2.0 to 5.0 hours.

3. The method of claim 1, wherein step 2 of said method is continued for 1.5 hours.

4. The method of claim 1, wherein step 3 of said method is continued for 3.0 hours.

5. The method of claim 1, wherein steps 1 through 3 are conducted while maintaining the temperature at a preferred range of 200 to 275 degrees Celsius.

6. The method of claim 1, wherein the preferred pressure at which the composition is maintained in step 2 is 20 inches of mercury and wherein the preferred pressure at which said composition is maintained in step 3 is 30 inches of mercury.

7. The method of claim 1, wherein the buffered acid composition is 23.0-33.0 percent by weight ammonia.

* * * * *